US007040329B2

(12) United States Patent
DeBoer et al.

(10) Patent No.: US 7,040,329 B2
(45) Date of Patent: May 9, 2006

(54) LOW-NOISE IN-SINK DISHWASHER

(75) Inventors: John M. DeBoer, St. Joseph, MI (US); Larry D. Marks, St. Joseph, MI (US); Andrew J. Retsema, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 391 days.

(21) Appl. No.: 10/138,371

(22) Filed: May 3, 2002

(65) Prior Publication Data

US 2003/0205255 A1 Nov. 6, 2003

(51) Int. Cl.
*B08B 3/02* (2006.01)

(52) U.S. Cl. ..... 134/115 R; 134/182; 134/183; 134/200

(58) Field of Classification Search ..... 134/115 R, 134/135, 182, 183, 198, 200, 201; 4/619, 4/631, 638, 656
See application file for complete search history.

(56) References Cited

U.S. PATENT DOCUMENTS

| | | | | | |
|---|---|---|---|---|---|
| 1,804,715 | A | * | 5/1931 | Tafel, Jr. | 134/153 |
| 1,995,331 | A | * | 3/1935 | Snyder et al. | 134/58 D |
| 2,230,059 | A | * | 1/1941 | Hurley, Jr. et al. | 248/132 |
| 2,579,393 | A | | 12/1951 | Modrey | 4/187 |
| 2,618,282 | A | | 11/1952 | Stanitz | 134/58 |
| 2,632,452 | A | * | 3/1953 | Spitzer | 134/115 R |
| 2,689,576 | A | * | 9/1954 | Colstad | 134/58 DL |
| 3,295,541 | A | * | 1/1967 | Ummel | 134/182 |
| 3,548,844 | A | * | 12/1970 | Sobel | 134/57 D |
| 3,709,236 | A | * | 1/1973 | Field et al. | 134/104.4 |
| 4,739,781 | A | * | 4/1988 | Casoli | 134/115 R |
| 4,985,106 | A | * | 1/1991 | Nelson | 156/276 |
| 5,178,172 | A | | 1/1993 | Morley | 134/183 |
| 6,105,403 | A | * | 8/2000 | Carow et al. | 68/196 |

FOREIGN PATENT DOCUMENTS

| | | | | |
|---|---|---|---|---|
| DE | 23 47 253 | * | 3/1975 | |
| GB | 929348 | | 6/1963 | 138/26 |
| JP | 3-97498 | * | 4/1991 | |
| JP | 4-187135 | * | 4/1992 | |
| JP | 4-193249 | * | 7/1992 | |
| JP | 4-314414 | * | 11/1992 | |
| JP | 9-103401 | * | 4/1997 | |
| JP | 10225330 | | 8/1998 | |
| JP | 10225331 | | 8/1998 | |
| JP | 2001-96090 | * | 4/2001 | |
| JP | 200187198 | * | 4/2001 | |
| JP | 2001-252497 | * | 9/2001 | |
| JP | 200127914 | * | 10/2001 | |
| JP | 2002-65552 | * | 3/2002 | |

* cited by examiner

*Primary Examiner*—Frankie L. Stinson
(74) *Attorney, Agent, or Firm*—Clifton G. Green; Robert O. Rice; John F. Colligan

(57) ABSTRACT

A dish-cleaning appliance comprising a sink having a bowl defining a wash chamber with an open top for providing access to the wash chamber. A liquid recirculation system is provided for spraying liquid onto the dish rack to effect the cleaning of any dishes along the rack. The lid is mounted to the sink and is movable to selectively cover the open top of the bowl. The lid includes a sound absorber and a sound dampener for reducing the transfer of sound from the wash chamber through the lid.

26 Claims, 12 Drawing Sheets

LOW-NOISE IN-SINK DISHWASHER

BACKGROUND OF THE INVENTION

1. Field of the Invention

The invention relates to an in-sink dishwasher for automatically washing household dishes without requiring the physical space of a built-in automatic dishwasher.

The invention further relates to an in-sink dishwasher having an sound absorbing lid for reducing the noise emitted by the in-sink dishwasher into the surrounding environment.

2. Description of the Related Art

In-sink dishwashers use the bowl of a sink to form part of the dishwasher housing that defines a wash chamber, with the open top of the bowl providing access thereto. A liquid recirculation system sprays wash liquid throughout the wash chamber to clean any dishes placed within. A lid covers the open top of the bowl when the in-sink dishwasher is being used to prevent the splashing or spraying of the recirculating wash liquid out of the open top of the bowl.

The impact of the sprayed liquid on the surface of the lid facing the wash chamber is transmitted through the lid and into the surrounding environment. The resulting environmental noise is undesirable by most consumers. Therefore, it is important to minimize the environmental noise generated by the in-sink washer.

SUMMARY OF THE INVENTION

The invention relates to a dish-cleaning appliance comprising a sink having a bowl defining a wash chamber with an open top for providing access to the wash chamber. A liquid recirculation system is provided for spraying liquid into the wash chamber for cleaning any dishes therein. The lid is mounted to the sink and is movable to selectively cover the open top of the bowl and thereby close the wash chamber. The lid comprises an upper surface and a lower surface. The upper surface faces away from the wash chamber when the lid covers the open top and the lower surface faces toward the wash chamber when the lid covers the open top. A sound absorption layer and a vibration-dampening layer are disposed between the upper and lower surfaces. The vibration-dampening layer can be disposed between the sound absorbing layer and one of the upper and lower surfaces.

The sound absorbing layer can be made from a fibrous layer forming interstitial spaces between the fibers. Non-woven fibers can be used. The vibration-dampening layer is made from a relatively dense material. A suitable material is mastic.

The sound absorbing layer is disposed between the vibration dampening layer and the upper surface. The vibration-dampening layer is located adjacent the lower surface.

The lid can further comprise a frame to which the upper and lower surfaces are mounted. A frame preferably circumscribes the sound absorption layer and the vibration-dampening layer. The frame can be made from a material that also has vibration-dampening characteristics to prevent the transfer of vibrations from the lower surface to the upper surface.

The lid further can comprise a gasket that is mounted to the frame and seals the lid relative to the sink. The frame can include a peripheral groove in which is received a portion of the gasket to thereby mount the gasket to the frame.

The lid can be hingedly mounted to the basket to effect selective movement of the lid to and from the closed position. The dish-cleaning appliance can also include a basket for receipt in the wash chamber and adapted to hold dishes and the like for cleaning.

The recirculation system preferably comprises a spray arm for spraying liquid throughout the wash chamber to clean the dishes therein. The spray arm is preferably mounted to a lower surface of the basket.

In another aspect, the invention relates to a dish-cleaning appliance comprising a sink having a bowl defining a wash chamber with an open top for providing access to the wash chamber. A liquid recirculation system is provided for spraying liquid into the wash chamber for cleaning any dishes therein. The lid is mounted to the sink and is movable to selectively cover the open top of the bowl and thereby close the wash chamber. The lid comprises an upper surface and a lower surface. The upper surface faces away from the wash chamber when the lid covers the open top and the lower surface faces toward the wash chamber when the lid covers the open top. A vibration dampening layer and a fibrous layer are disposed between the upper and lower surfaces. The fibrous layer is disposed between the vibration dampening layer and one of the upper and lower surfaces.

In another embodiment, the invention comprises a dish cleaning appliance comprising a sink having a bowl defining a wash chamber for receiving dishes to be washed. The sink having an open top for providing access to the wash chamber. A liquid recirculation system sprays liquid into the wash chamber for cleaning any dishes within the wash chamber. A lid is mounted to the sink and is movable to selectively cover the open top of the bowl and thereby close the wash chamber.

The lid comprises an upper surface facing away from the wash chamber when the lid covers the open top and a lower surface facing toward the wash chamber when the lid covers the open top. An acoustic frame is included and to which the upper surface and the lower surface are mounted such that the upper and lower surfaces are sonically isolated by the acoustic frame.

The frame preferably has an upper side and a lower side and the upper and lower surfaces are assembled to the frame from the same one of the upper and lower side. The upper and lower surfaces are preferably assembled to the frame from the upper side.

The appliance further comprise a gasket mounted to the lower side. Preferably, the fasteners extend through the frame lower side and into the lower surface to mount the lower surface to the frame. The gasket can overlie the fasteners and hide them from view.

The frame can have an exterior edge connecting the upper side to the lower side. Fasteners extend through the upper surface and into the exterior edge to mount the upper surface to the frame.

The lid can further comprising a vibration dampening layer disposed between the upper and lower surfaces. Additionally, the lid can include a fibrous layer disposed between the vibration dampening layer and one of the upper and lower surfaces.

DESCRIPTION OF THE PREFERRED EMBODIMENT

Figure 1:
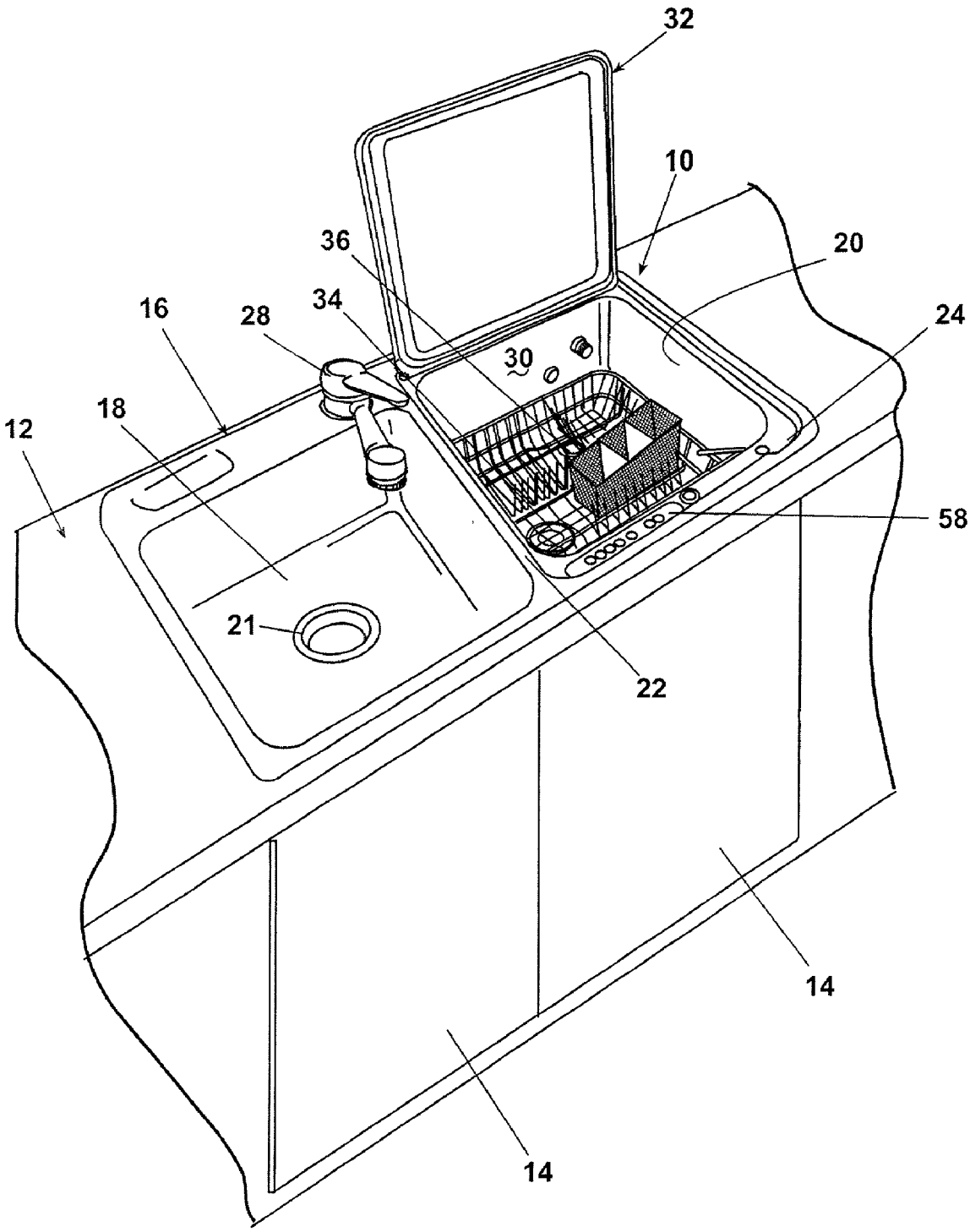
FIG. 1 is a perspective view of an in-sink dishwasher according to the invention, with the in-sink dishwasher shown mounted in a cabinet, the sink being of a double-bowl configuration and the one bowl forming part of the in-sink dishwasher having a lid, shown in an opened position, for covering the one bowl.

FIG. 1 illustrates an in-sink dishwasher 10 mounted in a traditional cabinet fixture 12 having doors 14 providing access to the cabinet interior where the lower portion of the in-sink dishwasher 10 is located.

The in sink dishwasher 10 is illustrated in the environment of a double-bowl sink 16 comprising a first bowl 18 and a second bowl 20. The first bowl 18 performs the function of a traditional sink bowl and includes a drain opening 21. The second bowl 20 performs the dual function of a traditional sink bowl while also forming a portion of the housing for the in-sink dishwasher.

The first and second bowls 18, 20 are spaced from each other to define an intervening flange portion 22 that intersects a peripheral flange 24 surrounding both of the bowls 18, 20. Preferably, the double-bowl sink is made from stainless steel.

A traditional water faucet 28 is located in the peripheral flange 24 of the double-bowl sink and provides water to either of the first and second bowls 18, 20.

Figure 2:
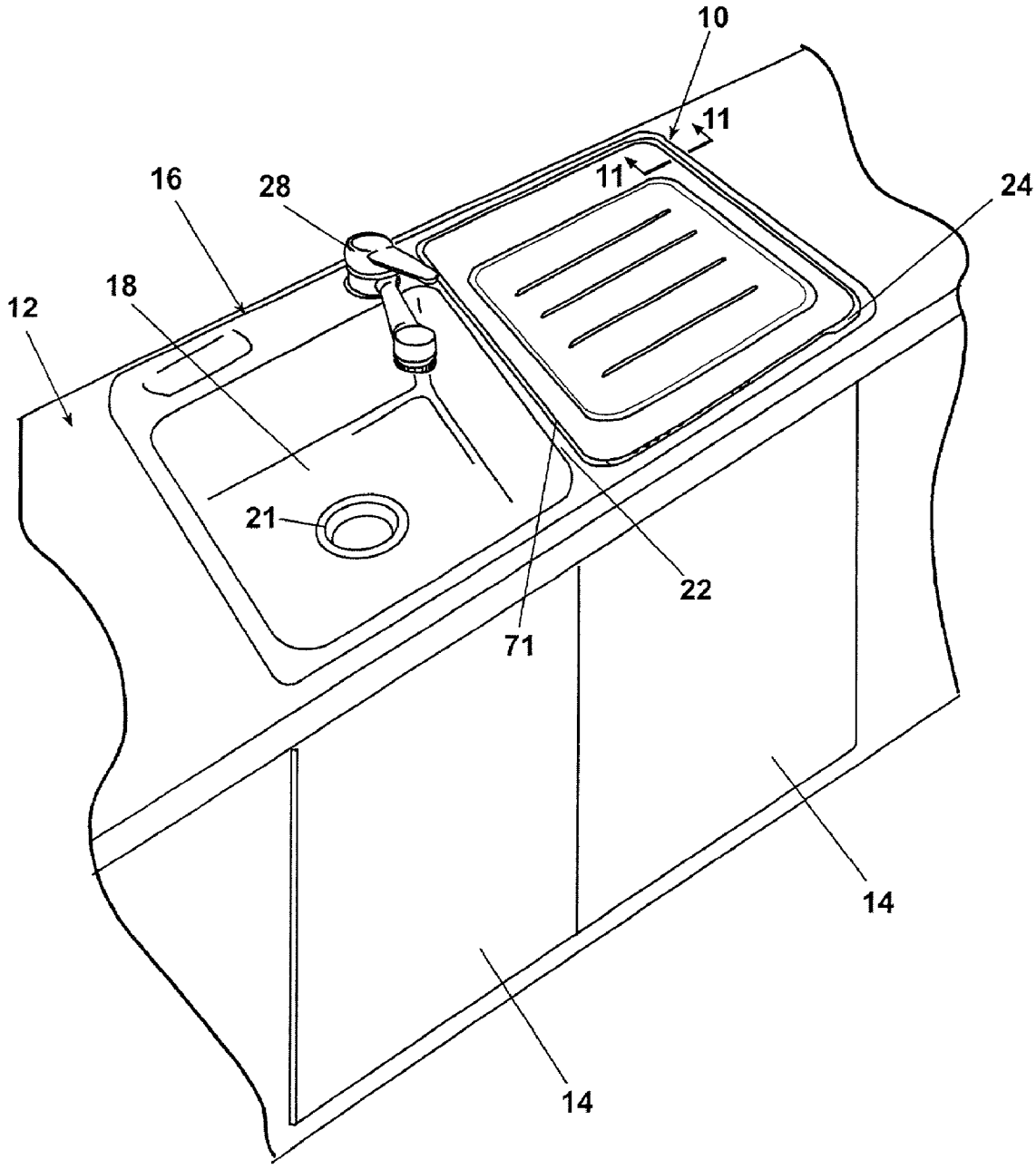
FIG. 2 is a perspective view substantially identical to FIG. 1 except that the lid is shown in the closed position.

Referring to FIGS. 1 and 2, the in-sink dishwasher 10 comprises a wash chamber 30 that is defined by the second bowl 18, which has an open top. A lid 32 is hingedly mounted to the peripheral flange 24 of the double-bowl sink 16 and is movable between an opened position as shown in FIG. 1 and a closed position as shown in FIG. 2.

A drain 34 along with a water inlet 36 are provided in the bottom of the second bowl 20 and provide for the draining and introduction of water from and into the wash chamber 30. The drain 34 is coupled to a drain line 35 that serves as a drain during the use of the bowl 20 as a traditional sink and when used as a wash chamber 30 for the in-sink dishwasher 10.

Figure 3:
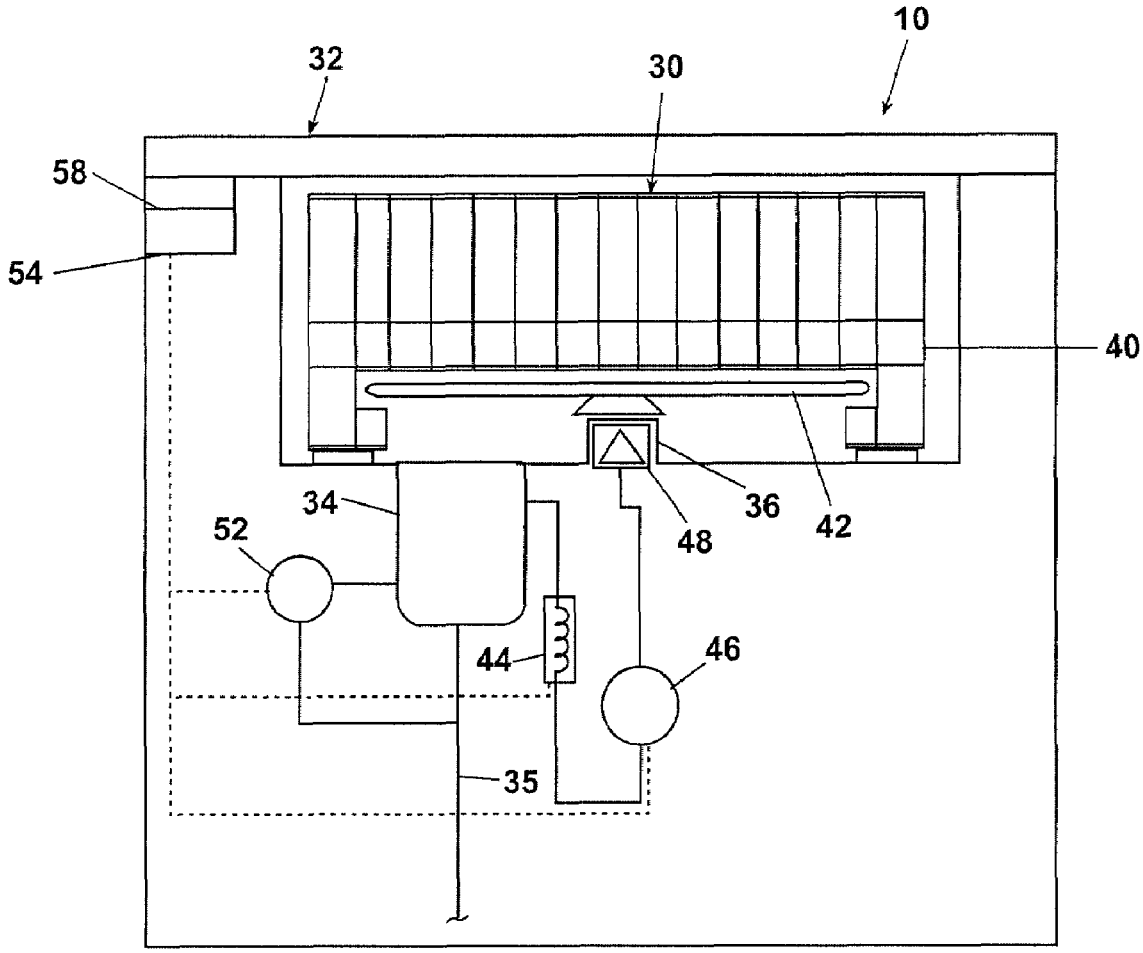
FIG. 3 is a schematic illustration of the major components of the in-sink dishwasher.

FIG. 3 schematically illustrates the major components of the in-sink dishwasher 10, which include a rack 40 comprised of multiple wire segments for holding various dishes and utensils. The exact shape and configuration of the rack 40 is not germane to the invention and is preferably made similar to those found in automatic dishwashers.

A spray arm 42 is preferably mounted to the bottom of the rack 40 such that the spray arm is free to rotate relative to the rack 40 and is removed from the wash chamber when the rack is removed. The spray arm 42 couples with the water inlet 36 when the rack 40 is positioned within the second bowl 20.

The drain 34 has one outlet that is fluidly coupled to an in-line water heater 44. The output of the water heater 44 is received as input to a recirculation pump 46, whose output is sent to a valve 48 forming part of the water inlet 36.

The drain 34, water inlet 36, in-line water heater 44, recirculation pump 46, valve 48, and spray arm 42 collectively form a recirculation system for recirculating wash liquid throughout the wash chamber 30.

The drain 34 has another outlet that is fluidly connected to a drain pump 52. The output of the drain pump 52 is fluidly connected to the traditional drain line for the second bowl 20. The drain pump 52 provides for a positive draining of liquid from the wash chamber 30, such as, for example, when it is no longer desire to recirculate the wash liquid with the recirculation system.

A controller 54, preferably a microprocessor-based controller, is electronically coupled to the in-line heater 44, recirculation pump 46, and drain pump 52 to control their respective operation. If the valve 48 is an actuated valve, such as a solenoid-actuated valve, instead of a check valve, then the controller 54 can also be connected to the valve 48 and control its operation.

The controller 54 operates the in-line heater 44, recirculation pump 46, and drain pump 52 to implement a wash cycle. Preferably, the wash cycle is one of many well-known wash cycles stored in the memory of the microprocessor.

A user interface 58 is located adjacent the second bowl 20 and is electronically coupled to the controller 54. The user interface 58 permits the user to select the desired wash cycle from the multiple wash cycles stored in the memory of the microprocessor and enter any necessary or optional operating data or parameters for the wash cycles.

Figure 4:
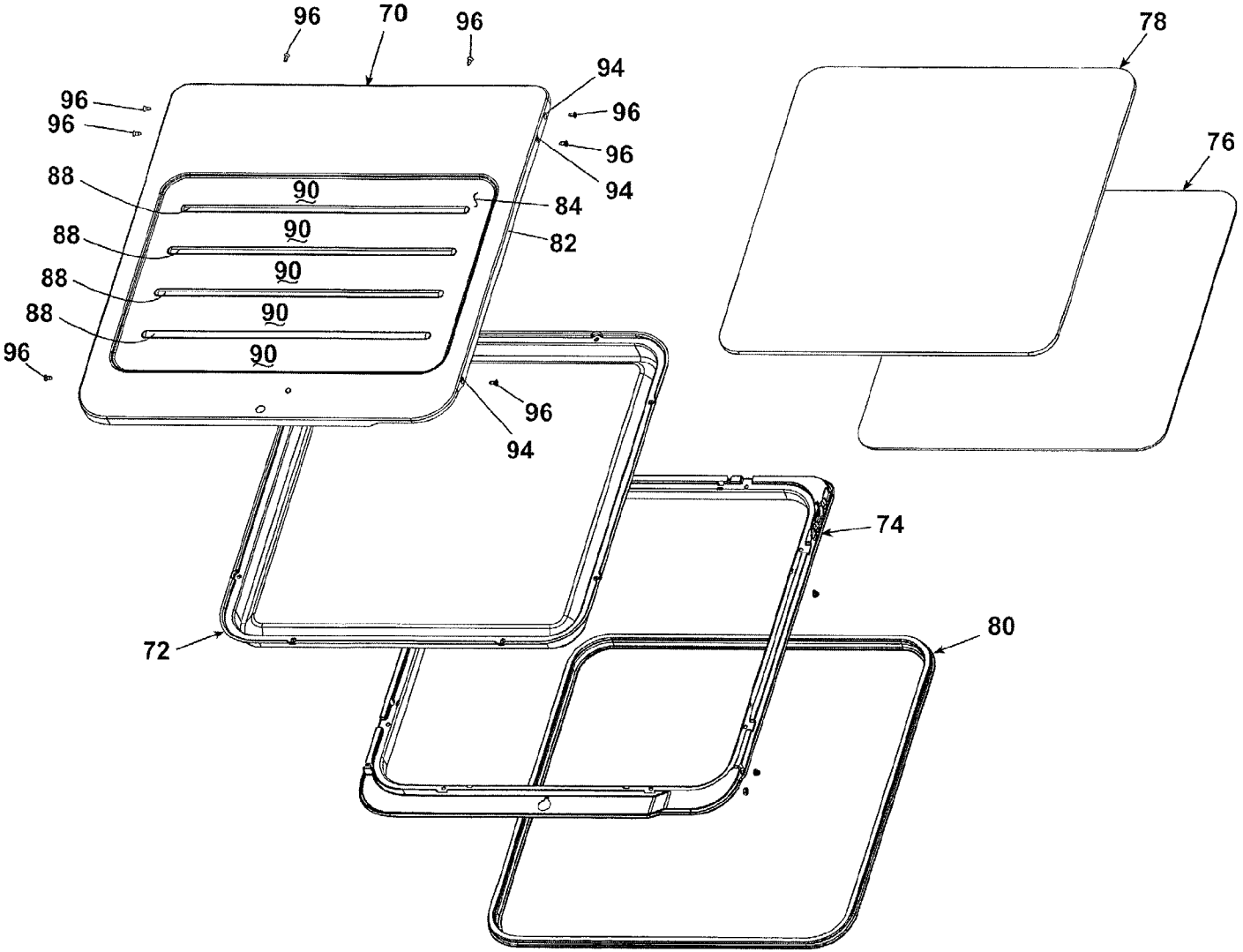
FIG. 4 is an assembly view of the lid of FIG. 1 and illustrating the major components of the lid comprising an upper lid and lower lid mounted to a frame carrying a gasket, with a sound absorber and sound dampener disposed between the upper and lower lid.

Referring to FIG. 4, the various components of the lid 32 are shown. The lid 32 comprises an upper surface 70 and a lower surface 72, which are both mounted to a frame 74 to form the structural skeleton for the lid 32. A sound absorption layer 78 and a vibration-dampening layer 76 are disposed between the upper surface 70 and lower surface 72 and circumscribed by the frame 74. A gasket 80 is mounted to the frame and seals the lid with respect to the sink.

Figure 5:
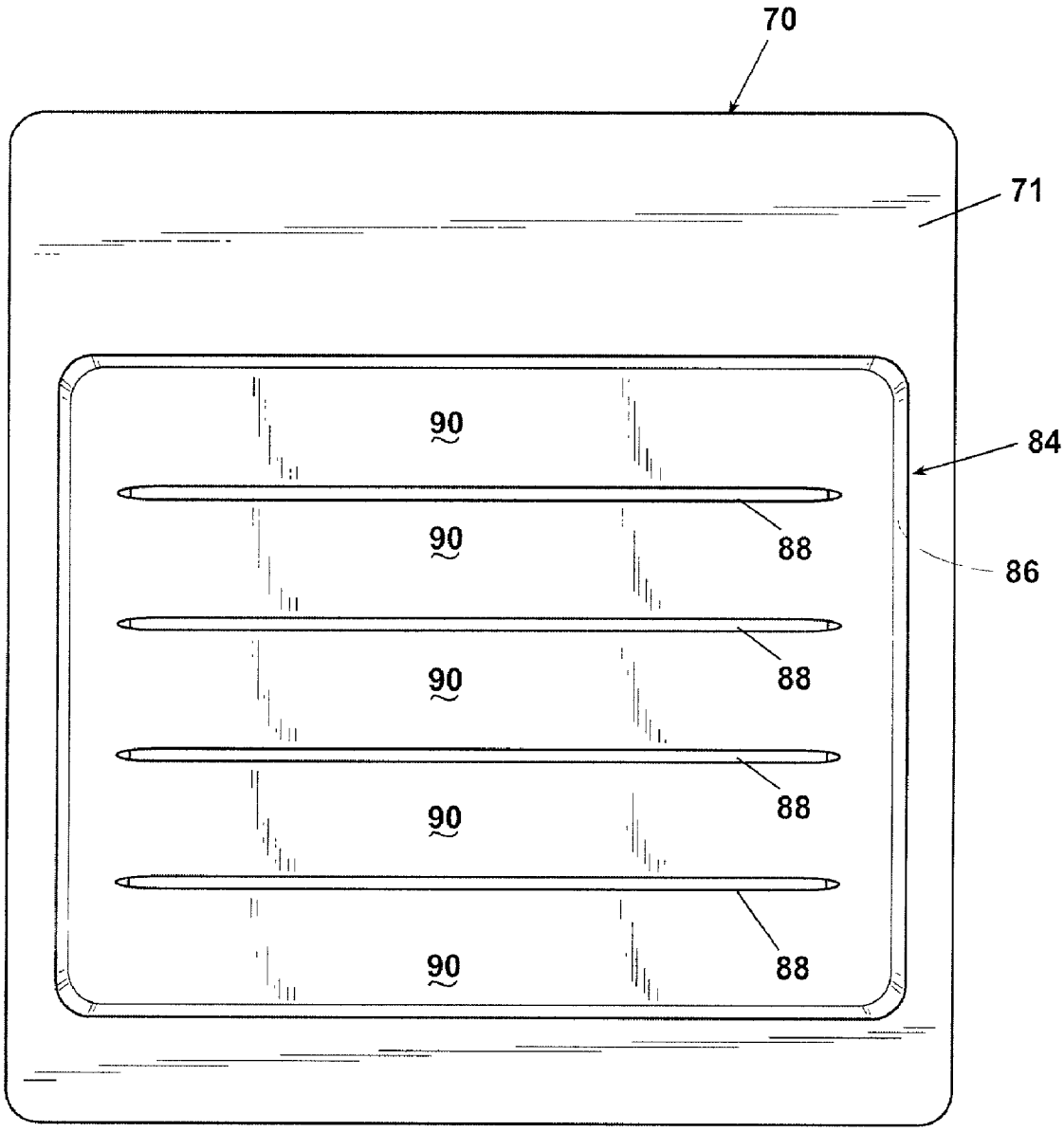
FIG. 5 is a top view of the lid of FIG. 1 and illustrating the upper surface of the lid.
Figure 6:
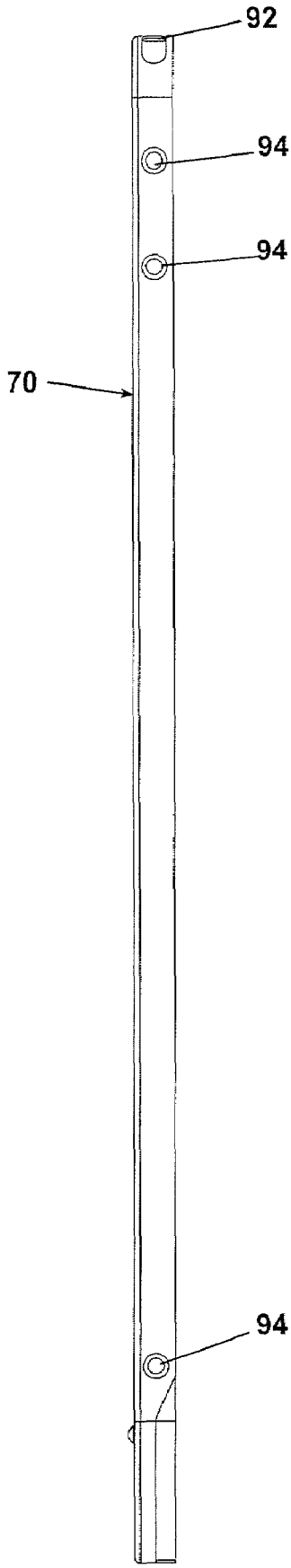
FIG. 6 is a right-side view of the upper surface of the lid.

Referring to FIGS. 4–6, the lid upper surface 70 has a generally planar top surface 71, which is bound by a depending lip 82. A recess 84 defined by a beveled periphery 86 is formed in the top surface 71 of the upper surface 70. The recess 84 is substantially rectangular and extends laterally across the upper surface 70. Preferably, the recess does not extend all the way to the peripheral edge of the lid.

A series of longitudinally extending ribs 88 are located in the recess 84 and effectively divide the recess 84 into multiple or sub-recesses 90. The ribs 88 are preferably of a height such that they do not extend beyond the plane defined by the upper surface 70.

A hinge arm opening 92 is formed in depending lip 82 in a rear edge of the upper surface 70 and is sized to receive the arm of a hinge (not shown) for hingedly mounting the lid 32 to the sink.

Fastener openings 94 are formed in the depending lip 82 and receive fasteners 96 for securing the upper surface 70 to the frame 74.

Figure 7:
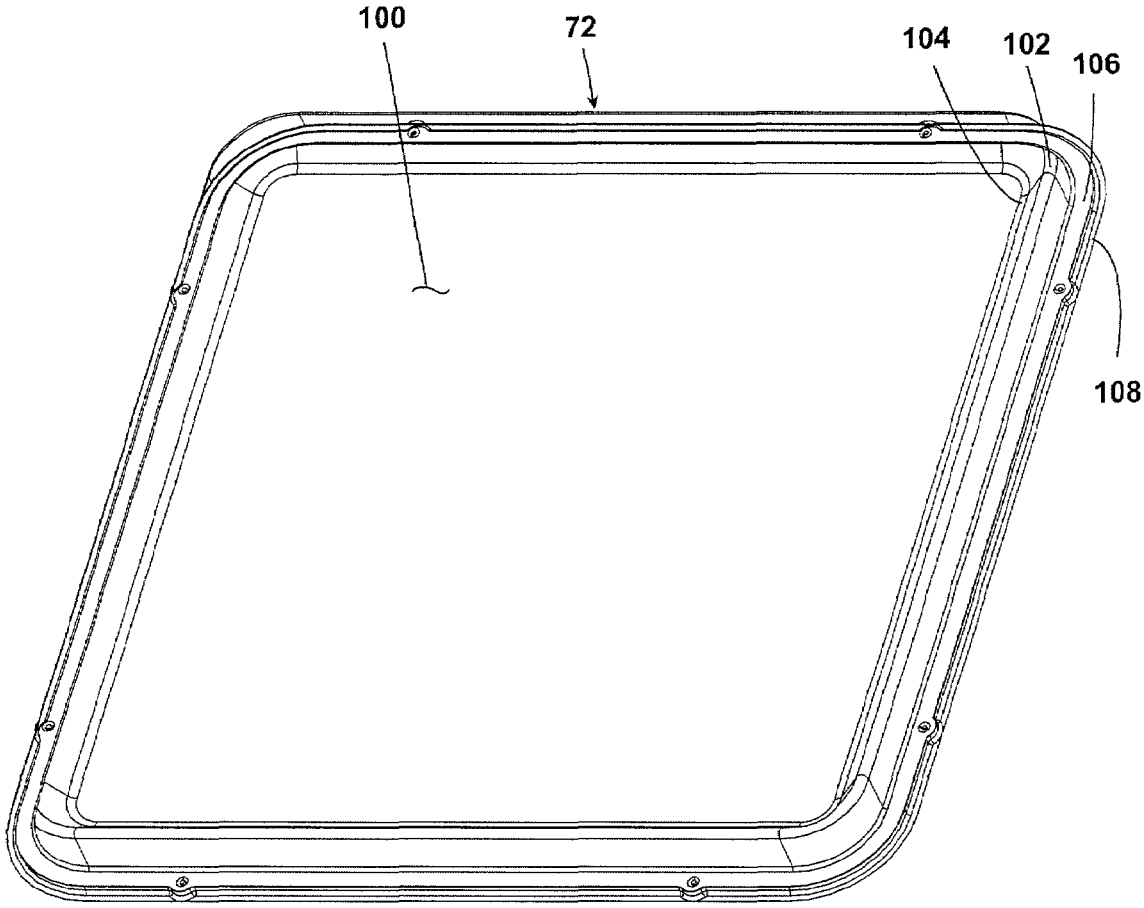
FIG. 7 is a bottom perspective view of the lower surface showing the lower surface as seen from within the sink.
Figure 8:
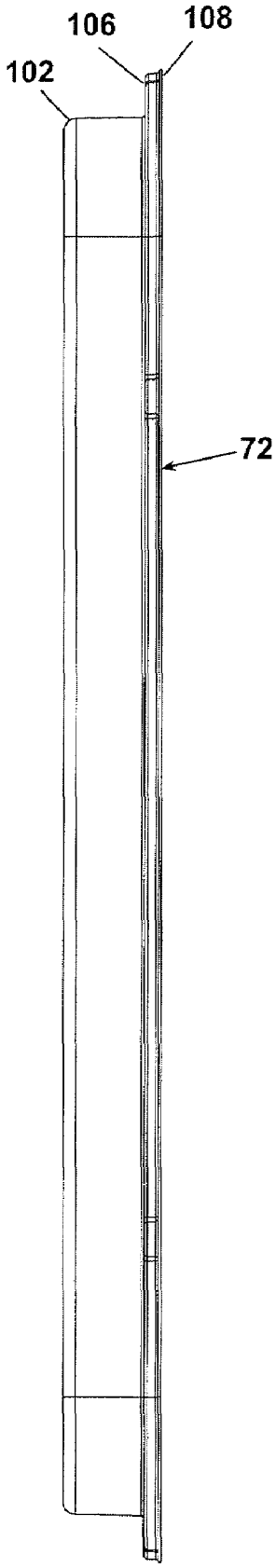
FIG. 8 is a side view of the lower surface.
Figure 9:
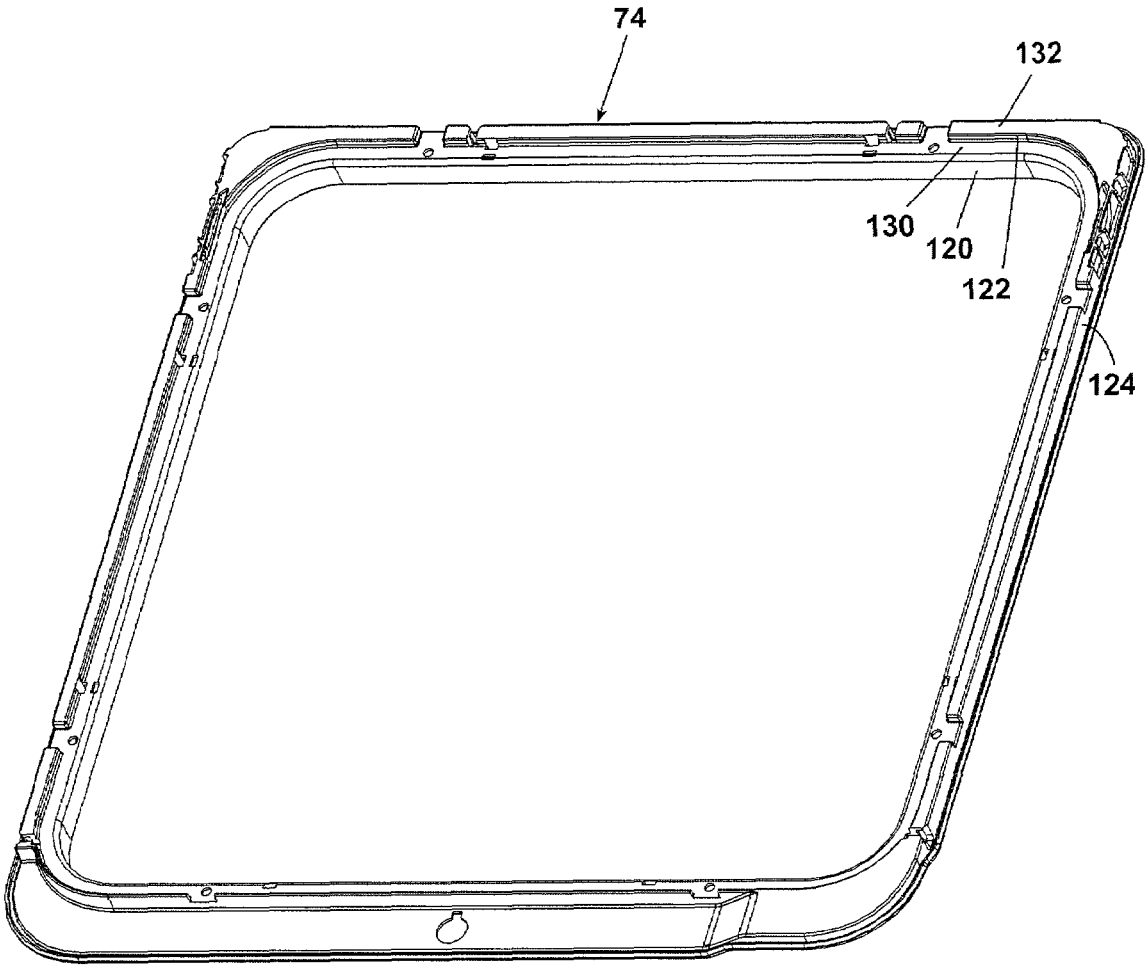
FIG. 9 is a top perspective view of the frame.
Figure 10:
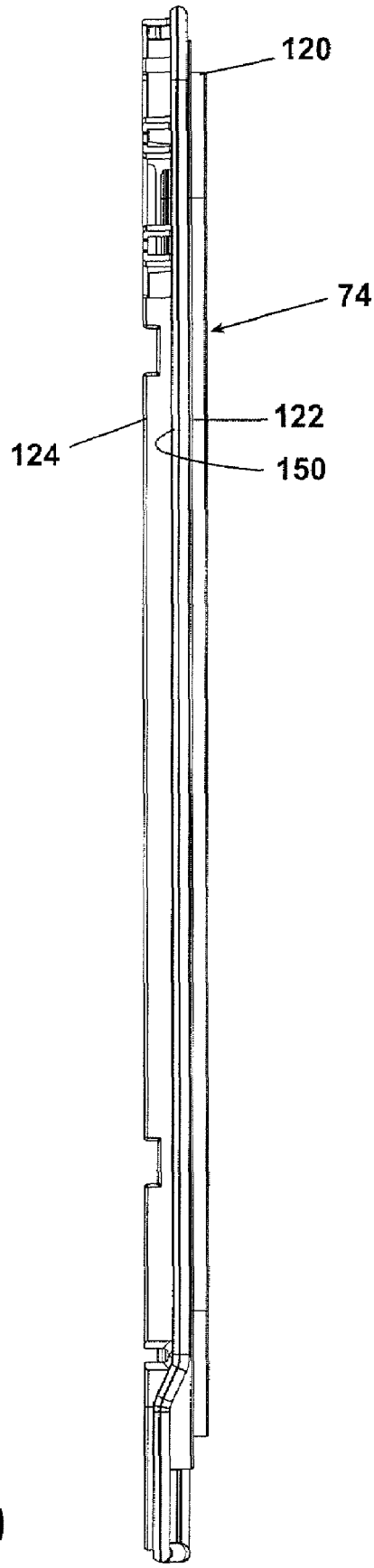
FIG. 10 is a side view of the frame.

Referring to FIGS. 4 and 7–8, the lower surface 72 of the lid 32 is shown in greater detail. The lower surface 72 comprises a generally planar central portion 100 that is circumscribed by a downwardly extending channel 102 (when viewed from FIG. 4), with an interior edge 104 formed by the junction of the channel 102 and the central portion 100 (see FIG. 11) and an outer edge formed by the outwardly extending lip 106. The lip 106 is positioned above the central portion 100. The peripheral mounting flange 108 extends from the peripheral lip 106. A series of openings 110 are formed in the peripheral lip 106 and are used in securing the lower surface 72 to the frame 74.

The upper and lower surfaces 70, 72, like the sink, are preferably made from stainless steel.

FIGS. 4 and 9–11 disclose the details of the frame 74, which comprises inner, middle, and outer walls 120, 122, and 124, which partially define an inner or gasket channel 126 and a middle channel 128. The inner wall 120 terminates below the middle wall 122 and is connected thereto by a first transverse wall 130, closing the bottom of the gasket channel 126. Similarly, middle wall 122 terminates below the outer wall 124. A second transverse wall 132 extends between the middle and outer walls to close the bottom of the middle channel 122.

A peripheral rib 134 extends from the first transverse wall 130 and into the gasket channel 126 and is interrupted by fastener openings 136. When assembled (FIG. 11), the lip 106 rests on the first flange 130 and fasteners extend through the lip and into the fastener openings to secure the lower surface 72 to the frame 74.

A plurality of dogs 138 extend from the inner wall 120 and middle wall 122 and into the gasket channel 126 and are used to secure the gasket 80 within the gasket channel 126. The dogs are spaced about the interior of the gasket channel 126.

Embossments 144 are formed in the middle channel 128 and function to strengthen the outer wall 124. The embossments 144 also provide a structure into which fasteners 96 can be received through the outer wall 124 and the openings 94 in the depending lip 82 of the upper surface to secure the upper surface 70 to the frame 74.

The outer wall 124 terminates in an upwardly turned lip 150 to define an outer channel 152, which is sized to receive the edge of the depending lip 82 of the upper surface 70 when the upper surface 70 is mounted to the frame 74. Multiple fastener openings 154 extend through the outer wall 124 and are used to receive fasteners 96 extending through the fastener openings 94 to thereby mount the upper surface 72 to the frame 74.

Preferably, the frame 74 is molded from a suitable plastic such as polypropylene. The plastic preferably has some flexibility to permit the inner, middle, and outer walls 120, 122, and 124 to at least slightly flex relative to each other, which aids in decoupling the movement of the inner surface from the outer surface. The plastic also has acoustic properties that prevent the transfer of sound and thereby sonically isolates the upper surface from the lower surface.

Figure 11:
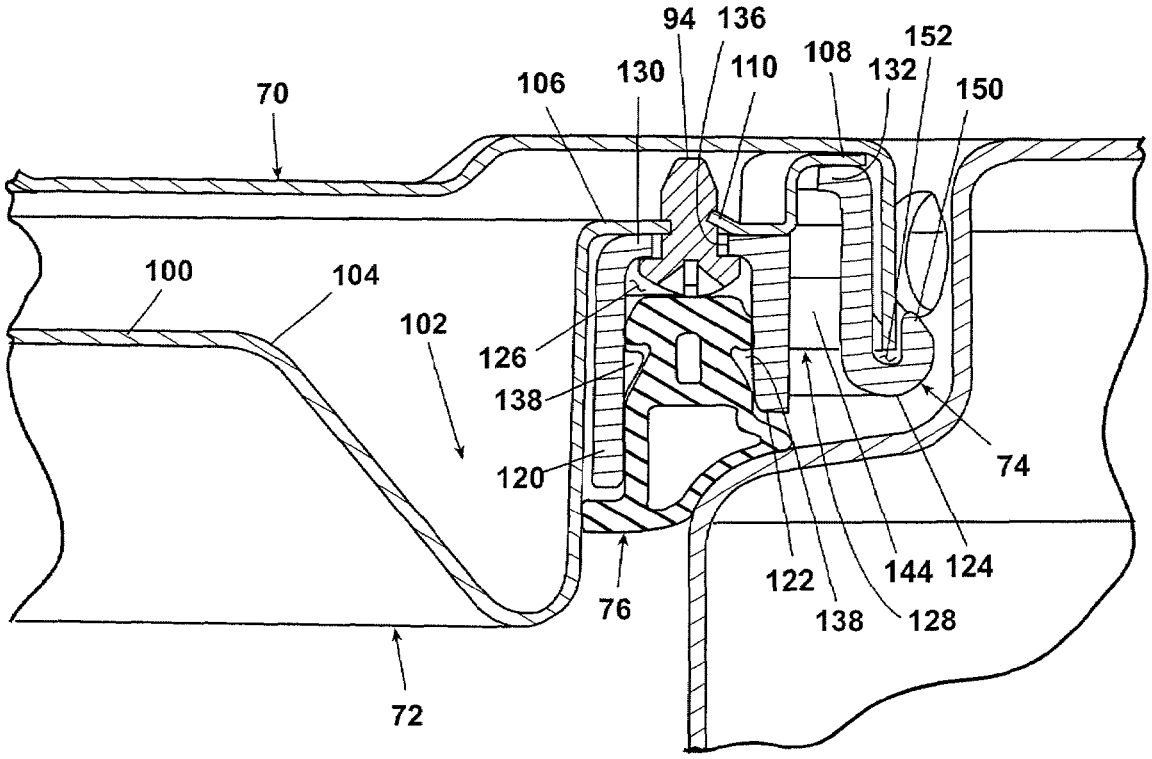
FIG. 11 is a sectional view taken along line 11—11 of FIG. 2 and illustrating the mounting of the gasket to the frame.

The structure of the frame 74 and the upper and lower surfaces 70, 72 are unique in that they permit one-side assembly. That is the upper and lower surfaces 70, 72 can be assembled to the frame 74 without flipping over the frame 74. The frame 74 can be thought of a having a upper side and a lower side. Referring to FIG. 11, the upper side is the side seen down or at the first and second transverse flanges 130, 132. The lower side is the side when looking up or at the open tops of the inner and outer channels 126, 144.

To assemble the upper and lower surfaces 70, 72 to the frame 74, the lower surface 72 is placed against the frame such that the channel lies within open interior of the frame 74 and the lip 106 and mounting flange 108 abuts the first and second transverse flanges 130, 132. A screw 96 passing though the opening 110 in the first transverse flange 130 to secure the lower surface 72 to the frame 74.

The upper surface is assembled to the frame by positioning the upper surface 70 such that the depending lip 82 is received within the outer channel 152. Screws 96 also pass through the openings 94 in the upper surface and into the outer wall 124 to secure the upper surface 70 to the frame 74. The gasket is received within the inner channel 126 and hides the screws 94 providing an aesthetically pleasant assembly.

Figure 12:
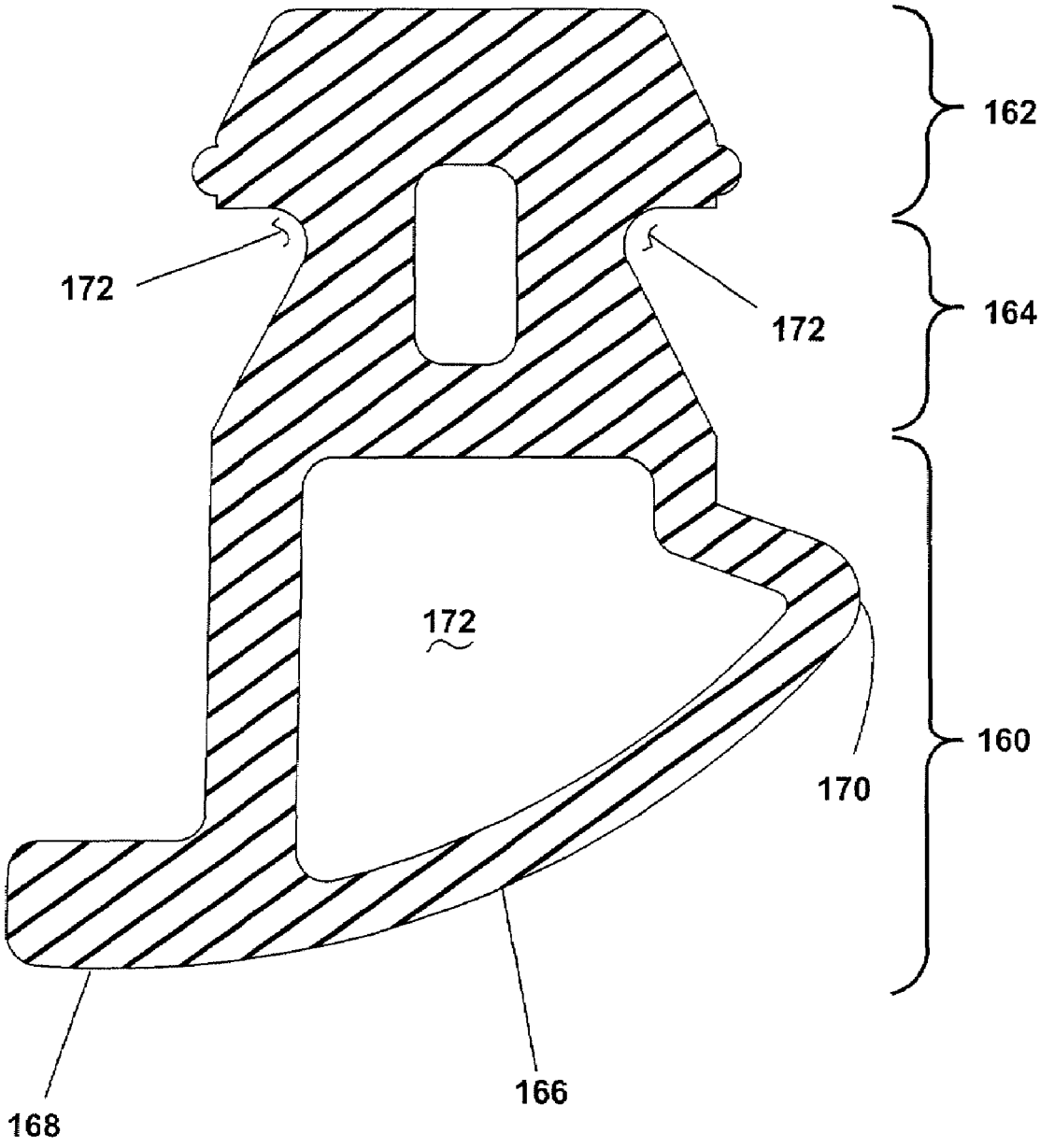
FIG. 12 is a sectional view of the gasket.

Referring to FIGS. 4 and 11–12, the gasket 80 comprises a hollow sealing body 160 connected to a base 162 by a tapered or neck portion 164. The sealing body 160 has a curved upper surface 166 terminating in an inner flange 168, which overlies the inner wall 120, and an outer flange 170, which overlies the middle wall 122. The curved upper surface 166 is compressible into the hollow interior 172 of the sealing body 160 to aid in sealing the lid 32 against the sink when the lid is in the closed position.

The junction of the base 162 and neck 164 forms annular grooves 172 having a cross section that is complementary to the profile of the dogs 138. To mount the gasket 80 within the gasket channel 126, the base 162 is inserted into the gasket channel 126 until the dogs 138 are received within the annular grooves 172. The receipt of the dogs 138 within the annular grooves 172 provides for the removable mounting of the gasket 80 to the frame 74, which permits the easy replacement of the gasket if needed.

When the lid 32 is assembled, the sound dampening layer 76 is preferably adjacent to or permanently affixed to the central portion 100 of the lower surface 72. The sound absorbing layer 78 is disposed between the vibration dampening layer 76 and the upper surface 70.

The vibration dampening layer 76 is preferably made from a very dense and nonporous material that substantially prevents the transfer of sound from the wash chamber to the upper surface 70 by dissipating vibration energy through conversion into heat. A preferred material is known as mastic and is affixed directly to the central portion 100 of the lower surface 72.

The sound absorbing layer 78 functions to absorb any sound waves and thereby further prevents the transfer of the sound to the upper surface 70 generated by the movement of the lower surface 72. A suitable material for accomplishing these functions is one that is compressible and porous, with a serpentine air path. The compressible nature of the material aids in absorbing any sound waves propagating from the vibration of the lower surface in the lid, whereas the porous nature of the material functions to create a longer path through which the sound waves must pass to reach the upper surface. The increased path length causes more reflections for the sound wave to make it through the material. The increased reflections absorb the sound waves by converting more of the wave pressure into mechanical energy by vibrating the material forming the sound absorption layer.

A preferred material is a fibrous batting. The fibrous batting is compressible and the interstitial spaces formed between the fibers increases the effective length that the sound must travel to pass through the sound absorption layer 78. The effective length of the sound path will be greater than the physical thickness of the fibrous batting. In the most preferred form, the fibrous batting comprises non-woven fibers, which are preferably sandwiched between woven support layers. The preferred fiber is polyester.

The lid construction according to the invention is especially advantageous in reducing or eliminating the sound generated by the in-sink washer and passing through the lid and into the surrounding environment. Most of the sound emanating from the wash chamber is created by the impact of the sprayed wash liquid as the liquid contacts the sink and the lower surface 72. The impact of the wash liquid on the lower surface 72 can transmit noise from the wash chamber through the lid by direct radiation and by inducing a vibration in the lower surface 72, which can be transferred to the upper surface 70 and into the surrounding environment.

The vibration associated with the impact of the wash liquid on the lower surface 72 is substantially eliminated solely by the mass of the vibration dampening layer 76. In other words, the mass of the vibration dampening layer 76 is sufficiently great enough that the force of the water acting on the lower surface 72 is not sufficient to induce a substantial vibration of the lower surface 72. To the extent that a vibration of the lower surface 72 is induced, the sound absorbing layer 78 will compress and expand in response to the vibrations to dampen the remaining vibrations.

The lid construction also stops the propagation of the sound from the wash chamber. Any sound that passes through the vibration-dampening layer is absorbed by the sound absorption layer as previously described.

The mounting of the upper surface and the lower surface to the frame also enhances the sound-reducing features of the lid. Since the upper surface and the lower surface are mounted to the frame and not to each other, the frame effectively decouples the upper surface and the lower surface for purposes of noise isolation. Therefore, there can be no direct transfer of sound between the upper and lower surfaces.

While the invention has been specifically described in connection with certain specific embodiments thereof, it is to be understood that this is by way of illustration and not of limitation, and the scope of the appended claims should be construed as broadly as the prior art will permit.

The invention claimed is:

1. A dish-cleaning appliance comprising:

a sink having a bowl defining a wash chamber for receiving dishes to be washed, and having an open top for providing access to the wash chamber;

a liquid recirculation system for spraying liquid into the wash chamber for cleaning any dishes within the wash chamber;

a lid mounted to the sink and movable to selectively cover the open top of the bowl and thereby close the wash chamber, the lid comprising:

an upper surface facing away from the wash chamber when the lid covers the open top, a lower surface facing toward the wash chamber when the lid covers the open top;

a sound absorption layer disposed between the upper and lower surfaces, and a vibration-dampening layer disposed between the sound absorption layer and one of the upper and lower surfaces.

2. The dish-cleaning appliance according to claim 1 wherein the sound absorption layer is a fibrous layer having interstitial spaces.

3. The dish-cleaning appliance according to claim 2 wherein the vibration dampening layer is mastic.

4. The dish-cleaning appliance according to claim 1 wherein the vibration-dampening layer is disposed between the sound absorber layer and the lower surface.

5. The dish-cleaning appliance according to claim 4 wherein the vibration-dampening layer is adjacent the lower surface.

6. The dish-cleaving appliance according to claim 1 wherein the lid further comprises a frame to which the upper and lower surfaces are mounted.

7. The dish-cleaning appliance according to claim 6 wherein the frame circumscribes the sound absorption layer and the vibration-dampening layer.

8. The dish-cleaning appliance according to claim 6 wherein the frame is made from a vibration-isolating material to reduce the transfer of sound vibrations from the lower surface to the upper surface through the frame.

9. The dish-cleaning appliance according to claim 6 and further comprising a gasket mounted to the frame.

10. The dish-cleaning appliance according to claim 9 wherein the frame comprises a peripheral groove in which is received a portion of the gasket to mount the gasket to the frame.

11. The dish-cleaning appliance according to claim 1 wherein the lid is hingedly mounted to the sink to permit the selective movement of the lid.

12. The dish-cleaning appliance according to claim 1 and further comprising a basket located within the wash chamber for holding dishes to be washed.

13. The dish-cleaning appliance according to claim 1 wherein the liquid recirculation system comprises a spray arm.

14. The dish-cleaning appliance according to claim 13 wherein the spray arm is mounted to a lower surface of the basket.

15. A dish-cleaning appliance comprising:

a sink having a bowl defining a wash chamber for receiving dishes to be washed, and having an open top for providing access to the wash chamber a liquid recirculation system for spraying liquid into the wash chamber for cleaning any dishes within the wash chamber;

a lid mounted to the sink and movable to selectively cover the open top of the bowl and thereby close the wash chamber, the lid comprising:

an upper surface facing away from the wash chamber when the lid covers the open top, a lower surface facing toward the wash chamber when the lid covers the open top;

a fibrous layer disposed between the upper and lower surfaces, and a vibration dampening layer disposed between the sound absorption layer and one of the upper and lower surfaces.

16. The dish-cleaning appliance according to claim 15 wherein the fibrous layer comprises a layer of non-woven fibers.

17. The dish-cleaning appliance according to claim 16 wherein the vibration dampening layer is mastic.

18. A dish-cleaning appliance comprising:

a sink having a bowl defining a wash chamber for receiving dishes to be washed, and having an open top for providing access to the wash chamber;

a liquid recirculation system for spraying liquid into the wash chamber for cleaning any dishes within the wash chamber;

a lid mounted to the sink and movable to selectively cover the open top of the bowl and thereby close the wash chamber, the lid comprising:

an upper surface facing away from the wash chamber when the lid covers the open top;

a lower surface facing toward the wash chamber when the lid covers the open top;

a frame to which the upper surface and the lower surface are mounted to form the lid; and wherein the frame sonically isolates the upper surface from the lower surface to minimize noise transmission.

19. The dish cleaning appliance according to claim 18 wherein the frame has an upper side and a lower side and the upper and lower surfaces are assembled to the frame from the same one of the upper and lower side.

20. The dish cleaning appliance according to claim 19 wherein the upper and lower surfaces are assembled to the frame from the upper side.

21. The dish cleaning appliance according to claim 20 and further comprising a gasket mounted to the lower side.

22. The dish cleaning appliance according to claim 21 and further comprising fasteners extending through the frame lower side and into the lower surface to mount the lower surface to the frame.

23. The dish cleaning appliance according to claim 22 wherein the gasket overlies the fasteners.

24. The dish cleaning appliance according to claim 23 wherein the frame comprises a exterior edge connecting the upper side to the lower side and further comprising fasteners extending through the upper surface and into the exterior edge to mount the upper surface to the frame.

25. The dish cleaning appliance according to claim 18 and further comprising a sound absorption layer disposed between the upper and lower surfaces.

26. The dish cleaning appliance according to claim 25 and further comprising a fibrous layer disposed between the vibration dampening layer and one of the upper and lower surfaces.

* * * * *